United States Patent [19]

Bachhuber

[11] Patent Number: 5,054,362

[45] Date of Patent: Oct. 8, 1991

[54] CONTROLLED SHOTSHELL ADVANCING MECHANISM FOR SHOTSHELL RELOADER

[75] Inventor: Robert L. Bachhuber, Mayville, Wis.

[73] Assignee: Mayville Engineering Company, Inc., Mayville, Wis.

[21] Appl. No.: 632,851

[22] Filed: Dec. 24, 1990

[51] Int. Cl.[5] ..... F42B 33/02

[52] U.S. Cl. ..... 86/27; 86/28; 86/33

[58] Field of Search ..... 86/23, 28, 31, 33, 24, 86/1.1, 27

[56] References Cited

U.S. PATENT DOCUMENTS

| | | | |
|---|---|---|---|
| 3,157,086 | 2/1964 | Bachhuber | 86/27 |
| 3,732,774 | 5/1973 | Griffin | 86/23 |
| 3,771,411 | 11/1973 | Hazel | 86/27 |
| 3,973,465 | 8/1976 | Bachhuber | 86/45 |
| 4,031,804 | 6/1977 | Boschi | 86/23 |
| 4,078,472 | 3/1978 | Simpson | 86/23 |
| 4,133,249 | 1/1979 | Bachhuber et al. | 86/23 |
| 4,522,102 | 6/1985 | Pickens | 86/27 |
| 4,526,084 | 7/1985 | David et al. | 86/38 |
| 4,615,255 | 10/1986 | Carter | 86/27 |

*Primary Examiner*—Deborah L. Kyle
*Assistant Examiner*—J. Woodrow Eldred
*Attorney, Agent, or Firm*—Wheeler Law Firm

[57] ABSTRACT

The invention is a shotshell advancing mechanism on a shotshell reloader with rotating turret held on a work table, a relatively movable tool carriage, and means to move the tool carriage so that the tools are in contact with the shot shells. The shotshell advancing mechanism is a gas spring means for providing motive force to move the turret. The invention is further comprised of: a first linkage means, in contact with the loading actuating means and the gas spring means, for compressing the gas spring means when the reloading actuation means produces relative motion that moves the tool carriage and the worktable toward each other; a second linkage means connected to both the first linkage means and the gas spring means, for engaging a section of the turret when the fluid compression-expansion means is compressed and for moving the turret section so engaged a pre-determined distance when the gas spring means expands; and a third linkage means for engaging a portion of the second linkage means when the tool carriage is moved toward the worktable by the reloading actuation means and for disengaging with the section linkage when the tool carriage is moved away from the worktable by the reloading actuation means; the gas spring means being capable of expanding when the third linkage disengages with the second linkage.

5 Claims, 3 Drawing Sheets

CONTROLLED SHOTSHELL ADVANCING MECHANISM FOR SHOTSHELL RELOADER

BACKGROUND OF THE INVENTION

This invention relates generally to the field of shotgun shell reloaders or shotshell reloaders such as are shown in U.S. Pat. No. 3,973,465. Known shotgun shell reloaders have included work stations at which each shell has a different task performed upon it in the process of reloading that shell and making it useable again. It is desirous to automatically feed or move these shells from one station to another station in a smooth, even and controlled manner so that the shells are not knocked off the worktable or thrown about on the worktable. The inventor knows of no prior art structure which moves shells on the worktable of a shotshell reloader in a smooth, even manner having the structure of his shotshell advancing mechanism.

SUMMARY OF THE INVENTION

The device of the invention is located on a shotshell reloader having a worktable, with a turret, to support shotshells to be reloaded and having a tool carriage, with shotshell reloading tools, mounted above the worktable, and having reloading actuating means for producing relative motion between the worktable and the tool carriage so as to move the tools on the tool carriage into and out of contact with the shot shells. The improvement that is the invention comprises a shotshell advancing mechanism for advancing the shotshells, located in the turret, on the worktable from a first position that is in relation to a first pre-determined tool to a subsequent position that is on the worktable that is in relation to a subsequent tool; the shotshell advancing mechanism having a fluid compression-expansion means, or gas spring means normally a cylinder containing a piston, for providing smooth motive force to move the turret, and advance a shotshell within the turret a predetermined distance when the fluid compression-expansion means expands. The invention is further comprised of: a first linkage means, in contact with the loading actuating means and the fluid compression-expansion means, for compressing the fluid compression-expansion means when the reloading actuation means produces relative motion that moves the tool carriage and the worktable toward each other; a second linkage means, connected to both the first linkage means and the fluid compression-expansion means, for engaging a section of the turret when the fluid compression-expansion means is compressed and for moving the turret section so engaged a pre-determined distance when the fluid compression-expansion means expands; and a third linkage means for engaging a portion of the second linkage means when the tool carriage is moved toward the worktable by the reloading actuation means and for disengaging with the section linkage when the tool carriage is moved away from the worktable by the reloading actuation means; the fluid compression-expansion means being capable of expanding when the third linkage disengages with the second linkage.

The fluid normally contained in the fluid compression-expansion means is a gas although other fluids, like hydraulic oils, may be used.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
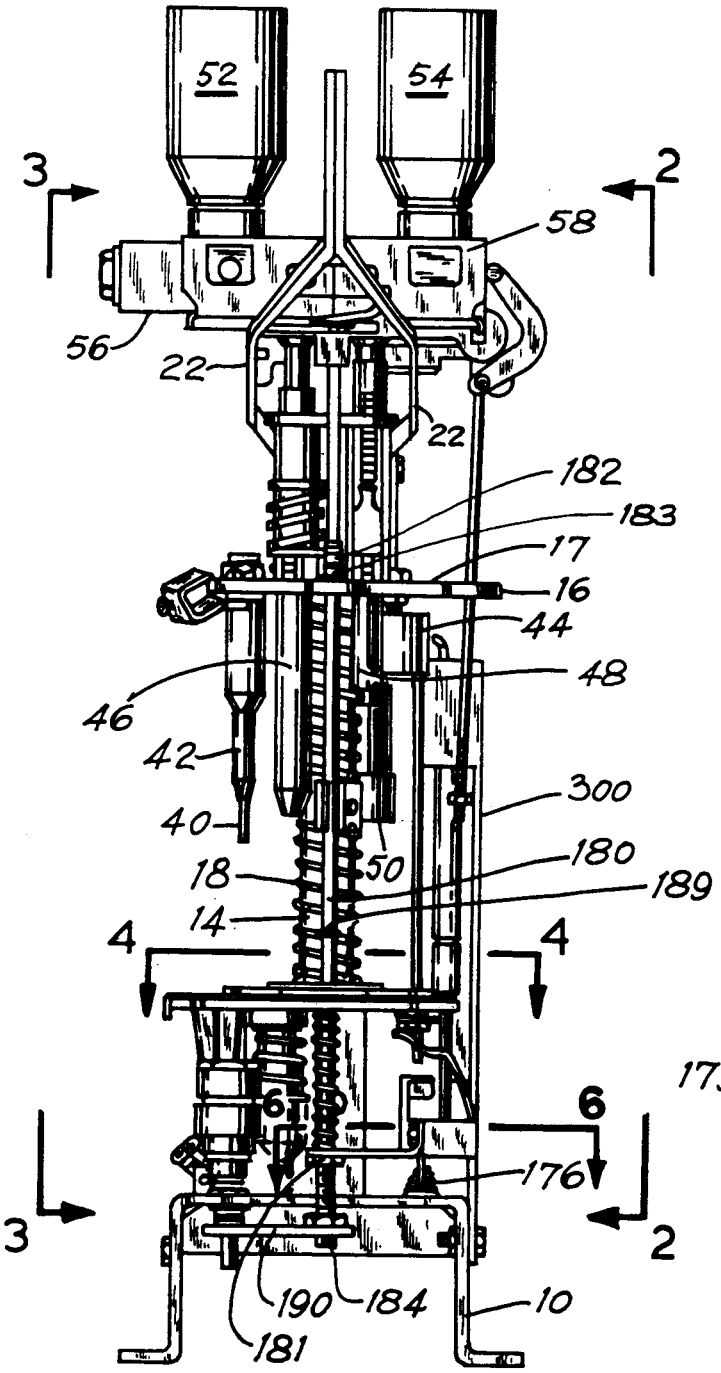
FIG. 1 is a front elevational view of the shotshel reloader and the controlled shotshell advancing mecha nism.
Figure 6:
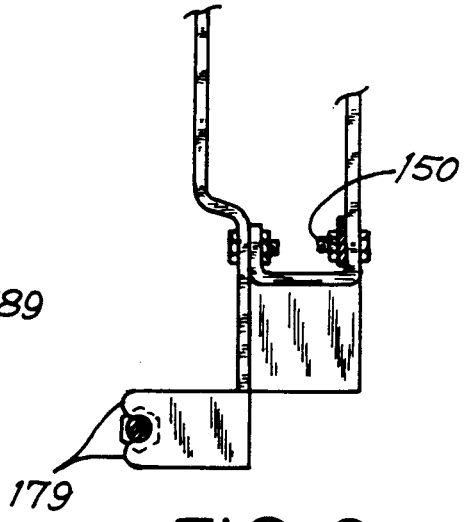
FIG. 6 is a view from line 6—6 of FIG. 1.

Referring to FIG. 1, the shot shell loader that the invention is combined with includes a base 10, a work table 12 supported on the base 10, a post 14 attached to the base 10 and extending upwardly through the center of the work table 12 and a tool carriage 16 slidably mounted on the post 14 and normally spring biased away from the work table 12 by a compression spring 18. The tool carriage 16 has a bracket 20 attached to it and to which a lever arm 22 is pivotally connected at pivot connection 24. The lever arm 22 has a forward portion 26 that extends past the pivot connection 24 and forms on obtuse angle with the lever arm 22. A forward portion 26 is pivotally connected at pivot connection 28 to a link 30 which pivotally connected at pivot connection 32 to a post 14. Another lever arm 22 connected at its free end to the first lever arm 22 to form a forked lever similarly has a forward portion 26 that is pivotally connected to another link 30 on the opposite side of the bracket 20, the ends of the forward portions 26 and the links being spaced apart by a spacer sleeve 34. The opposite end of the two lever arms 22 are joined together at junction 36 and carry a common handle 38. When handle 38 is pulled down, the lever arms 22 force the bracket 20 and tool carriage 16 downwardly against the bias of the spring 18. When the handle 38 is released, the spring 18 pushes the tool carriage 16 and bracket 20 upwardly to position shown in FIG. 1.

A plurality of known reloading tools are attached to the carriage 16 and project downwardly therefrom toward a work table 12, which is adapted to support shot gun shells that are to be re-loaded. The re-loading tools include a primer ejection punch 40, a sizing die 42, a crimping die 44, a primer dispenser and inserting ram 46, a powder and shot tube 48, and a wad support 50. Powder and shot tube 48 is connected to powder container 52 and shot container 54 via a conventional slide valve 56. The containers 52 and 54 are mounted on a bracket 58 attached to the top of the post 14.

Figure 4:
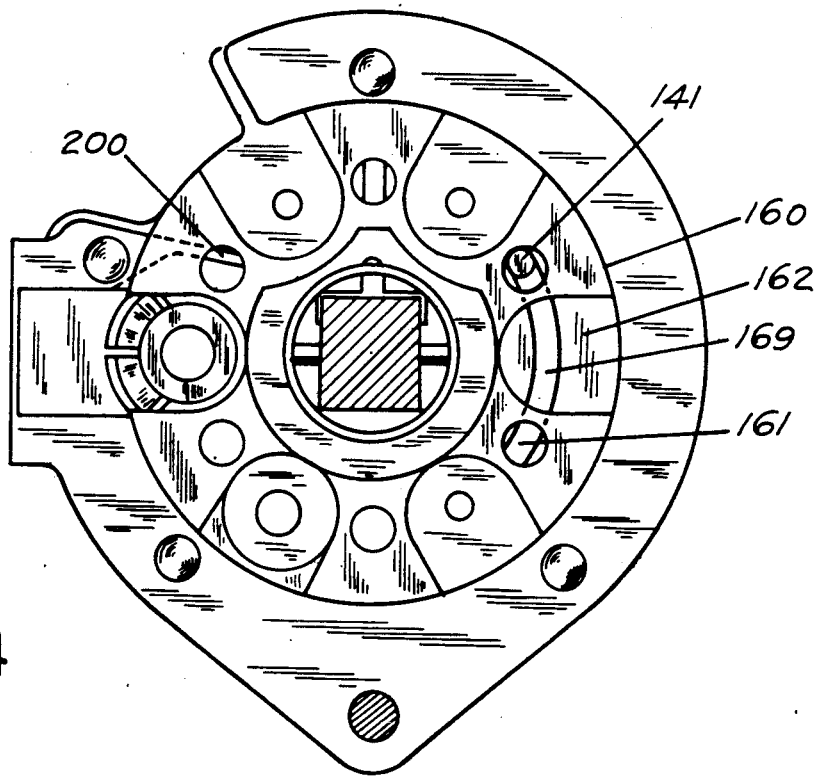
FIG. 4 is a top plan view of the worktable and turrei of the shotshell reloader.

As shown in FIG. 4, the shot shell re-loader has a rigidly notched turret disk 160 which is rotatably attached to the top of the work table 12 and has six radially disposed slots 162 which are dimensioned to received the ferrule portion of an empty shotgun shell and hold the same in position and below the corresponding one of the re-loading tools. In between each slot 162 an opening 161 is located in a portion of the turret disk 160. All of the shotgun shells in the turret disk 160 are simultaneously rotated from one re-loading tool to the next when the disk 160 is rotated from one position to the next. During the re-loading process, six shotgun shells are normally carried by the turret disk 160 and the six different re-loading operations are preformed simultaneously on the six shells every time the tool carriage 16 is moved downwardly to bring the re-loading tools into contact with the shotgun shells.

Figure 2:
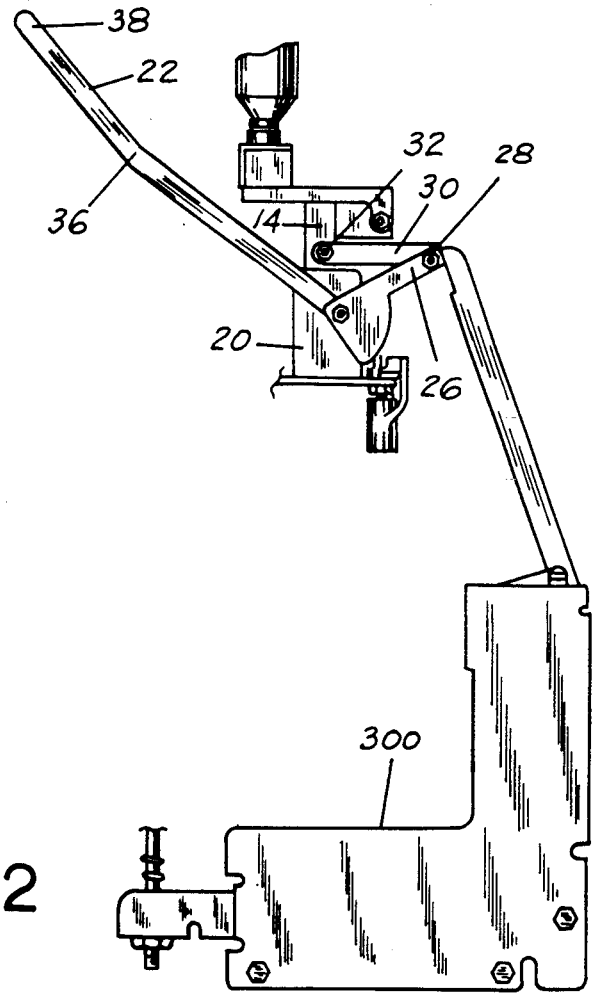
FIG. 2 is a side elevational view of the controllec shot shell advancing mechanism.
Figure 3:
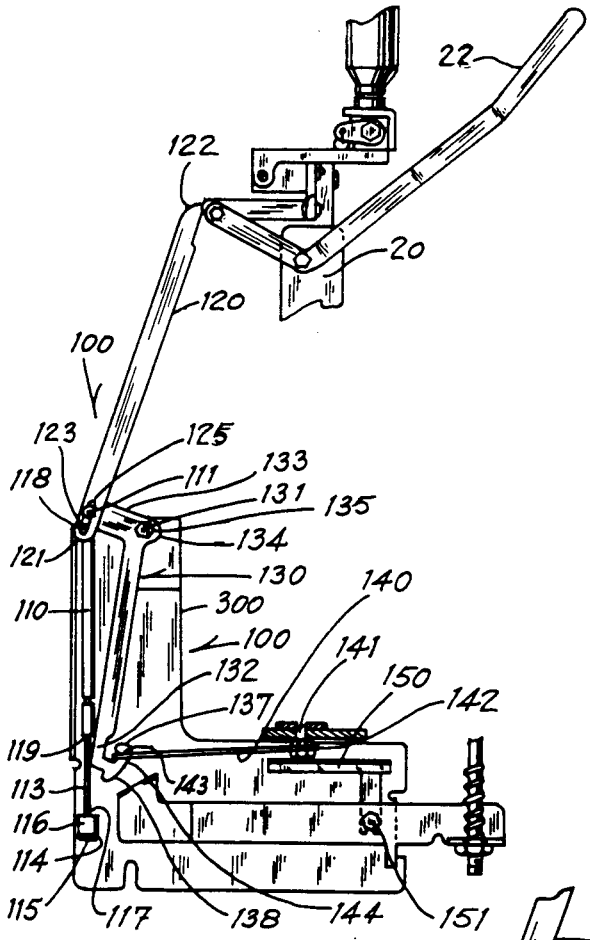
FIG. 3 is a side elevational view of the controllec shotshell advancing mechanism.
Figure 5:
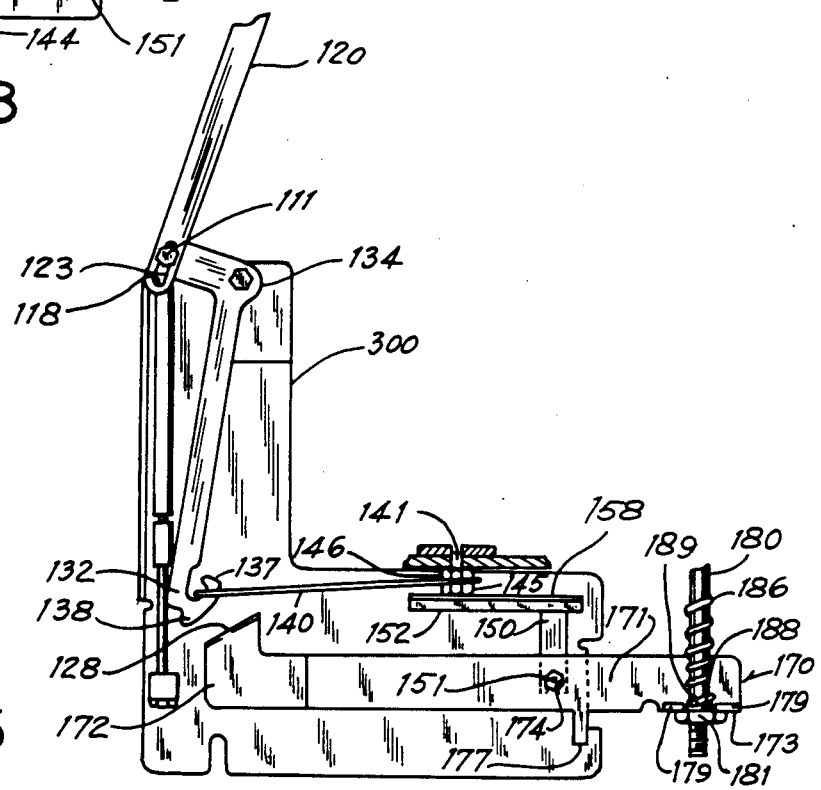
FIG. 5 is an enlarged veiw of FIG. 3.

Now referring to FIG. 2, FIG. 3 and FIG. 5, the invention, an indexing unit 100 that is used to smoothly advance the shells located in the turret disk 160, may be seen. The indexing unit 100 comprises: a sealed gas cylinder or gas spring 110 having a piston rod 113 with an end 114 that extends out of an end 119 of the sealed gas cylinder or gas spring 110; a gas cylinder top end 118; a block 116 with an opening 117 for receiving the end 114 of the piston rod 113; an opening 111 located on the end 114 for receiving a bolt 115 and thus securing end 114 to the block 116; an L-shaped connecting arm 130 having an end 133, a heel section 134, and a hooked end 132 comprising two hook sections 137 and 138; a bolt 131 for securing the heel section 134 of the L-shaped connecting arm 130 to a pivot point 135; an indexing rod 140 having two ends 142 and 143, and also having an indexing tooth 141 located on end 142, and an opening 143 on end 144 that is engaged with hook section 137 of the hooked end 132 of the L-shaped connecting arm 130; a fixed leaf spring 150 having a fixed end 151 that is bolted to the base 10 of the shot shell loader, a beveled sliding surface 152 that is perpendicular to the length of the body 153 of the fixed leaf spring 150; a linkage 120 having ends 121 and 122; a pivoting linkage mechanism 170; and a rod 180. The L-shaped connecting bar 130 is fixedly attached at its end 133 to the top end 118 of the gas cylinder 110 by means of the bolt 111 and nut 136. Also, end 121 of the linkage is slidably connected to both the top end 118 of the gas cylinder 110 and end 133 of the L-shaped connecting arm 130 through a slotted opening 123 contained in the end 121 of the linkage 120. End 122 of the linkage 120 is fixedly connected to linkages 26 and 30 by and at bolt 28.

The linkage mechanism 170 is comprised of a metal linkage bar 171 having a hooked end 172, a flat L-shaped end 173, a pivot point 174 located at bolt 151, a volute spring 176, and a pivot stop 177. The flat L-shaped end 173 has a crescent shaped edge 178 having horns 179. The horns 179 are engagable with the top 188 of a hex nut 181 that is located on the rod 180. Hook section 138 of the L-shaped connecting bar 130 is designed to engagé with hooked end 172 of the linkage mechanism 170.

The rod 180 has a top end 182 that has a flange gasket 183 that is engagable with the top surface 17 of the tool carriage 16 and a bottom end 184 that is attached to a linkage 190. Nut 181 is located near the bottom end 184. A spring 186 is located between the topside of the nut 181 and the bottom side of the worktable 12 so that bottom end 189 of the spring 186 is located between the crescent horns 179 of the end 173. For purposes of the instant invention it is only important to note that the connection of the bottom end 184 to the linkage 190 merely stabilizes that end of the rod 180 while still allowing the rod 180 to move in a vertical manner up and down. A middle portion 186 of the rod 180 passes through opening 19 of the work table 12; this provides further stability to the rod 180.

The invention works as follows: with the top surface 158 of the beveled sliding end 152 in contact with the base 145 of the indexing tooth 141 the lever arm 22 is pushed downwardly to force the bracket 20 and the tool carriage 16 against the bias of the spring 18. This causes the linkages 30 and 26 to move so that point 28 moves downward and towards the post 14 causing end 122 of the linkage 120 to be drawn toward work table 12. As end 122 is moved toward the work table 12, end 121 is moved downwardly toward and slightly away from the work table 12. This causes the slot end 125, located within the slot 123, to engage the bolt 111 that connects to both the top 118 of the gas cylinder 110 and the end 133 of the L-shaped connecting bar 130 to each other, so that end 132 of the L-shaped connecting bar 130 is moved toward the post 14 and the cylinder 110 is compressed. This results in the piston 113 being pushed into the cylinder 110 so that there is an increase in the pressure of the gas contained within the cylinder 110.

Simultaneously, as the lever 22 is pushed downward the tool carriage 16 is lowered so that the compressed spring 186, located between the nut 181 and the bottomside of the worktable 12, is able to expand. This causes end 173 of the linkage mechanism 170 to lower until it is stopped by the pivot stop 177. Accordingly, hooked end 172 is raised by the action of the volute spring 176 so that hook section 138 of hooked end 132 of the L-shaped connecting arm 130 can slide across the pitched surface 178 to engage the hooked end 172; as end 132 of the L-shaped connecting arm 130 swings towards the post 14.

Concurrent with the above functions, the indexing rod 140 that is in engagement with the hooked section 137 is pushed horizontally by end 132 so that the base 145 of the beveled indexing tooth 141 slides along the top surface of the horizontal section 153 of the fixed leaf spring 150 from one opening 161 to another opening 161 in the turret disk 160, the bevel top portion of the tooth 141 being constrained to the path defined by the opening 169 located on the work table 12.

The handle 22 is then released and the spring 18, pushing against the tool carriage 16, expands. This causes the lever 22 to move upwardly so that linkages 30 and 26 move to cause point 28 to travel upwards and away from the post 14. This results in end 122 of the linkage 120 being drawn away from the post 14. Accordingly, end 121 is also moved upward and slightly towards the post 14. However, this movement of end 121 does not move the bolt 111 that connects end 118 of the gas cylinder 110 to end 133 of the L-shaped connecting bar 130 because the slot 123 provides sufficient space to allow the spring 118 of the post 14 to fully expand against the tool carriage 16 without allowing the bolt 111 to contact the bottom section 124 of the slot 123.

Instead the compressed cylinder 110 is left free to expand at a smooth fixed rate so that the section 134 is moved, at that same fixed rate, in a generally upward direction toward the post 14. Once hook end 172 of the linkage mechanism 170 is disengaged with hook section 138 of the L-shaped connecting bar. Hook end 172 is released by the following process: When the handle 22 is released the tool carriage 16 rises, under pressure from the spring 18 so that the top surface 17 of the tool carriage 16 contacts the flange gasket 183 that is at the top end 182 of the rod 180. Because the strength of expansion of the spring 18 is greater than the strength of expansion of the spring 186 the rod 180 is pulled upward along with the tool carriage 16 causing the spring 186 to be compressed and the nut 181 to engage the crescent horns 179 of the linkage mechanism 170. This raises the end 173 of the linkage mechanism 170 and causes the volute spring 176 to be compressed and the end 172 to be lowered, releasing the hooked section 138 of the L-shaped connecting arm 130. Once end 138 is released the gas cylinder or gas spring 110 is free to expand at a smooth, fixed rate. This causes end 132 of the L-shaped connecting arm 130 to move away from the post 14 pulling the indexing rod 140 and the indexing tooth 141 that is engaged with an opening 161 that is located on the turret disk 160. Therefore, the turret disk 160 is advanced a set degree because the movement of the indexing tooth 141 is constrained to the path defined by the opening 169 that is located in work table 12. The movement is also constrained by the predetermined expansion of the gas within the cylinder 110. This distance is exactly equal to the distance necessary to advance a shell located in one of the slots 162 of the shot shell loader so as to advance it to the next station on the work table 12. The turret disk 160 is turned, accordingly, by the action of expansion of gas within the cylinder 110. This movement is smooth and even so that all the shells on the turret disk are advanced in a smooth and even fashion.

An additional improvement of the shot shell loader is the use of a metal guard 200 adjust at the last station on the turret table 160 where a completed shell is removed, so that as each shell is advanced past the last station the base of the shell engages the guard 200 which is positioned to cause the shell to eject from the work table 12 as the turret disk turns in a smooth fashion so a new shell may be immediately inserted at the next station and the shells continue to be reloaded in a smooth uninterrupted manner.

The above described embodiments of this invention are merely descriptive of its principles and are not to be limited. The scope of this invention instead shall be determined from the scope of the following claims, including their equivalents.

What is claimed is:

1. On a shotshell reloader having a worktable, with a turret, to support shotshells to be reloaded and having a tool carriage, with shotshell reloading tools, mounted above the worktable, and having reloading actuating means for producing relative motion between the worktable and the tool carriage so as to move the tools on the tool carriage into and out of contact with the shot shells, the improvement comprising:

a shotshell advancing mechanism for advancing the shotshells located in the turret on the worktable from a first position in relation to a first pre-determined tool to a subsequent position on the worktable in relation to a subsequent tool;

said shotshell advancing mechanism having a fluid compression-expansion means for providing motive force to move the turret and advance a shotshell within the turret a predetermined distance when said fluid compression-expansion means expands;

first linkage means, connected to the loading actuating means and said fluid compression-expansion means, for compressing said fluid compression-expansion means when the reloading actuation means produces relative motion that moves the tool carriage and the worktable toward each other.

a second linkage means, connected to both said first linkage means and said fluid compression-expansion means, for engaging a section of the turret when said fluid compression-expansion means is compressed and for moving the turret section so engaged a pre-determined distance when said fluid compression-expansion means expands; and a third linkage means for engaging a portion of said section linkage means when the tool carriage is moved toward the worktable by the reloading actuation means and for disengaging with said section linkage when the tool carriage is moved away from the worktable by the reloading actuation means;

said fluid compression-expansion means being capable of expanding when said third linkage disengages with said second linkage.

2. The device of claim 1 in which said fluid compression-expansion means is a sealed gas cylinder with a piston having a piston end that is fixedly attached to a portion of the shotshell loader and having a cylinder end that is fixedly attached to a portion of said first linkage means and is slidably engagable with a portion of said second linkage means.

3. The device of claim 1 in which said first linkage means is a linkage rod having a first end and a second end;

said first end being connected to a portion of said reloading actuation means and said second end having an opening that is slidably engagable with a portion of said fluid compression-expansion means.

4. The device of claim 1 in which the second linkage means is an L-shaped linkage having a first end, a middle heel section, and a hooked end section; and said fluid compression-expansion means has a fixed end connected to a portion of the shotshell reloader and a free end;

said first end being fixedly attached to said free end of said fluid compression-expansion means;

said middle heel section being pivotably connected to a portion of said shotshell loader;

said hooked end section being engageable with said third linkage means when the reloading actuation means is used to move the tool carriage toward the worktable and said fluid compression-expansion means is compressed.

5. The device of claim 1 in which said third linkage means comprises a pivoting linkage having a hooked end, a middle pivoting point that is fixedly attached to a portion of the shotshell loader, a pivot stop that is engageable with a portion of the shotshell loader, and an L-shaped flat end having a crescent shaped edge that is engageable with a portion of the reloading actuation means.

* * * * *